US008480024B2

(12) United States Patent
Ries

(10) Patent No.: US 8,480,024 B2
(45) Date of Patent: Jul. 9, 2013

(54) CORRUGATED PAPER REEL

(75) Inventor: William J. Ries, North Lawrence, OH (US)

(73) Assignee: Vail Industries Inc., Navarre, OH (US)

( * ) Notice: Subject to any disclaimer, the term of this patent is extended or adjusted under 35 U.S.C. 154(b) by 0 days.

(21) Appl. No.: 12/681,046

(22) PCT Filed: Oct. 3, 2008

(86) PCT No.: PCT/US2008/078749

§ 371 (c)(1),
(2), (4) Date: Jul. 9, 2010

(87) PCT Pub. No.: WO2009/046297

PCT Pub. Date: Apr. 9, 2009

(65) Prior Publication Data

US 2010/0264246 A1 Oct. 21, 2010

Related U.S. Application Data

(60) Provisional application No. 60/977,261, filed on Oct. 3, 2007.

(51) Int. Cl.
*B65H 75/18* (2006.01)

(52) U.S. Cl.
USPC ..... 242/608.7; 242/610.1

(58) Field of Classification Search
USPC ..... 242/608, 608.7, 610.1, 118.1, 532.5, 242/586.6, 118.61, 586
See application file for complete search history.

(56) References Cited

U.S. PATENT DOCUMENTS

| | | | | | |
|---|---|---|---|---|---|
| 2,380,641 | A | * | 7/1945 | Freiler | 242/610.1 |
| 2,799,458 | A | * | 7/1957 | Nye | 242/118.8 |
| 3,101,846 | A | * | 8/1963 | Eifrid | 242/610.1 |
| 3,222,011 | A | * | 12/1965 | Lewis | 242/118.8 |
| 3,284,022 | A | | 11/1966 | Eifrid | |
| 3,412,847 | A | * | 11/1968 | Wise et al. | 242/588.4 |
| 3,661,341 | A | | 5/1972 | Eifrid | |
| 3,817,475 | A | * | 6/1974 | Goldstein | 242/607.1 |
| 3,853,286 | A | * | 12/1974 | Beder et al. | 242/607.1 |
| 3,876,073 | A | * | 4/1975 | Herbetko | 242/608.7 |
| 3,958,775 | A | * | 5/1976 | Liga | 242/118.8 |
| 4,019,692 | A | * | 4/1977 | Hanson | 242/610.2 |
| 4,244,538 | A | * | 1/1981 | Theros | 242/118.8 |
| 5,203,516 | A | * | 4/1993 | Donaldson | 242/608.7 |
| 5,509,620 | A | * | 4/1996 | Crews | 242/608 |
| 5,735,483 | A | * | 4/1998 | Bierlein | 242/608.7 |
| 5,791,590 | A | * | 8/1998 | Zuk et al. | 242/610.6 |
| 5,806,788 | A | * | 9/1998 | Witwer et al. | 242/608.6 |
| 6,575,398 | B2 | * | 6/2003 | Nakamura et al. | 242/608.7 |
| 2007/0181739 | A1 | * | 8/2007 | Derendal | 242/608.5 |
| 2007/0262192 | A1 | * | 11/2007 | Derendal | 242/608.5 |

OTHER PUBLICATIONS

PCT/US2008/078749 International Search Report, and Written Opinion, mailed Dec. 2, 2008.

* cited by examiner

*Primary Examiner* — William A Rivera
(74) *Attorney, Agent, or Firm* — Fay Sharpe LLP

(57) ABSTRACT

A collapsible reel having a high strength to weight ratio is provided. The collapsible reel comprises a core, around which a flexible media is wound, and flanges which prevent the wound flexible media from migrating axially off of the core. The core is formed of first and second blanks having hub portions and a plurality of spaced apart tabs projecting from the hub portions. To form the core, the tabs of each blank are folded and the tabs of the first blank are secured to the corresponding tabs of the second blank. The flanges are then adhered to the outer surface of the hub portions.

14 Claims, 13 Drawing Sheets

CORRUGATED PAPER REEL

This application claims the priority benefit of U.S. provisional application Ser. No. 60/977,261, filed Oct. 3, 2007, the disclosure of which is incorporated herein by reference.

BACKGROUND OF THE INVENTION

The present invention generally to reels for supporting or storing flexible media such as wire or cable, and will be described with particular reference thereto. However, it is to be appreciated that the present invention is also amenable to other like applications.

Reels for supporting wound flexible media have been used for many years and are employed to both store and facilitate the dispensing of wound media such as rope, wire, electric cable, tubing, chain, strings of parts and the like. The general components of a reel include its core, around which the flexible media is wound, and its flanges, which prevent the wound flexible media from migrating axially off of the core.

Conventionally, wooden reels or even composite wooden and metal reels have been used to store and dispense media. However, such reels have been expensive to manufacture, cannot be shipped in a knocked-down condition, or if so shipped, required extensive labor by the end user in order to erect them and were themselves substantially heavy. Once empty, the reels must be disposed of or returned for reuse. Disposal is generally not an environmentally viable option. Further, because the manufacture of these reels is expensive, disposal is not economically advantageous.

On the other hand, the return transportation of these reels present other problems. For instance, cable reels take up a considerable amount of space which imposes a limitation on the number of reels which can be loaded on a vehicle. As such, the transportation of empty cable reels can represent another significant cost.

Thus, well-designed reels must combine a high strength to weight ratio with low manufacturing cost. The reels are preferably reusable and capable of disassembly or reduction in size when empty. One reel design that has gained popularity for certain applications includes a collapsible reel in which the core is constructed of a pressed paperboard material and the flanges are constructed of a composite or plastic material. The use of paper and plastic components, in general, provides a high strength to weight ratio compared to wood and metal, is less expensive to transport and easier to manipulate, and facilitates the use of relatively straightforward manufacturing techniques. Moreover, paper products are generally easier to recycle. Another lightweight reel design consists of a pressed paperboard collapsible core and corrugated paper flanges.

Although attempts have been made to manufacture a collapsible, reusable reel, the prior art still has many disadvantages and drawbacks. For instance, many of the collapsible reels are too complicated and too expensive to manufacture. Other reels are not strong enough to withstand the loads of many media when reeled upon the core. Still other prior art constructions remain bulky and difficult to handle even when collapsed.

In light of the foregoing, it becomes evident that there is a need for a collapsible reel that would provide a solution to one or more of the deficiencies from which the prior art and/or conventional reels have suffered. It is still more clear that a collapsible reel providing a solution to one or more of the needs left by the prior art while providing a number of heretofore unrealized advantages thereover would represent an advance in the art. Accordingly, a need exists for a lightweight collapsible reel that has a high strength to weight ratio with low manufacturing cost.

BRIEF DESCRIPTION OF THE INVENTION

In accordance with the present invention, a collapsible reel having a high strength to weight ratio is provided. The collapsible reel comprises a core, around which a flexible media is wound, and flanges which prevent the wound flexible media from migrating axially off of the core. The core is formed of first and second blanks having hub portions and a plurality of spaced apart tabs projecting from the hub portions. To form the core, the tabs of each blank are folded and the tabs of the first blank are secured to the corresponding tabs of the second blank. The flanges are then adhered to the outer surface of the hub portions.

The present invention provides a high strength collapsible reel for supporting heavy loads, which is constructed of a lightweight material.

The present invention provides a heavy duty, heavy load reel constructed substantially entirely of lightweight corrugated paper board.

A further aspect of the present invention relates to a locking feature that self-locks on assembly of the reel and can be easily released for purposes of collapsing.

Yet another aspect of the present invention is to provide a heavy duty reel which can be shipped in flattened condition and can be easily erected by the end user without machinery, tools, or equipment such as an adhesive, staples and other securing devices.

Yet another feature of the present invention is to provide a reel construction which will support heavy loads, and which, while being made entirely of corrugated paper board, will not deteriorate under adverse weather conditions.

Preferred embodiments of the corrugated paper reel advantageously feature a spindle construction of increased strength by incorporating a third ply, combined angles that provide strength on the order of 50 pounds on a wound reel, scores on the spindle flanges that allow the assembly to be self-erecting and maintain its assembled shape without use of metal or adhesive, and scores on fold portions that increase volume on the reel.

Still other non-limiting aspects of the disclosure will become apparent from a reading and understanding of the description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION OF THE PREFERRED EMBODIMENTS

Figure 1:
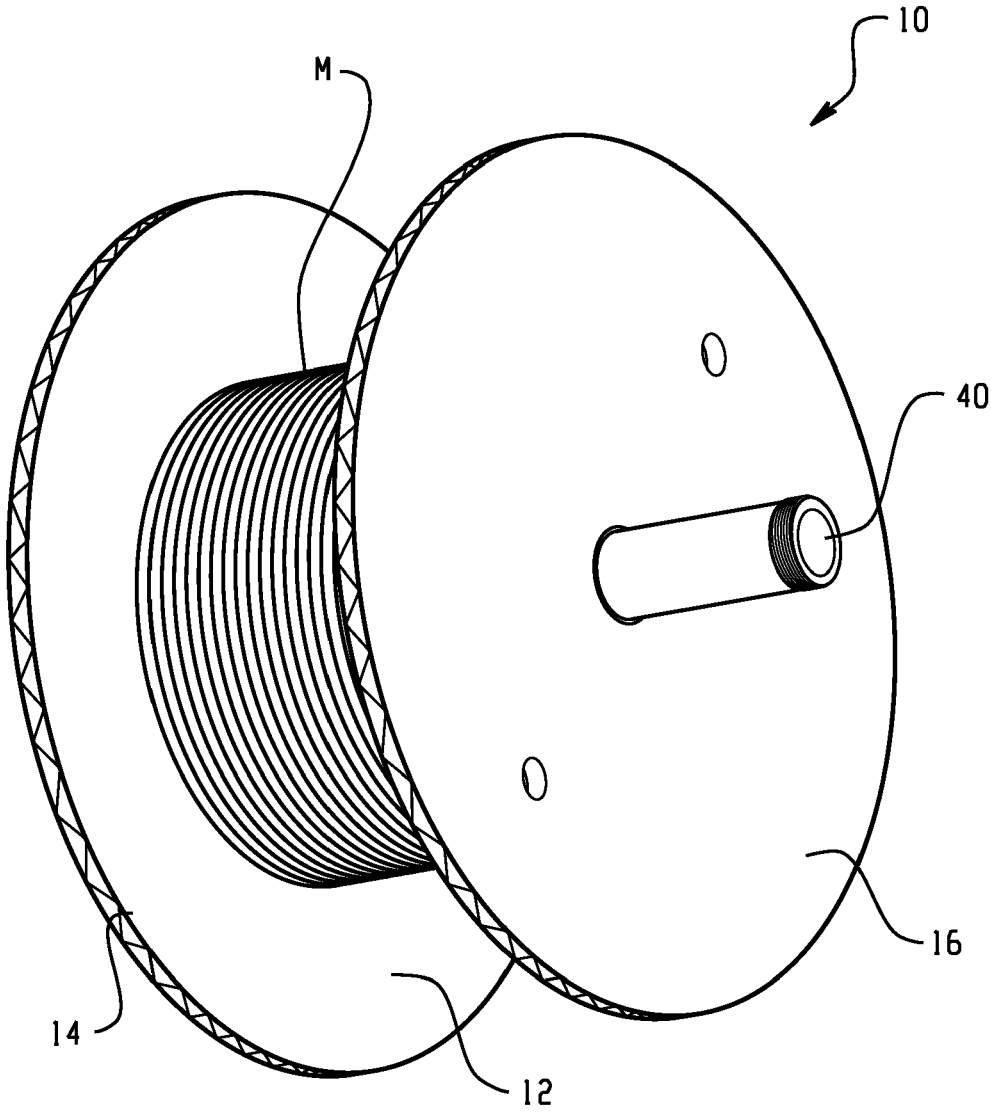
FIGS. 1-4 are various perspective views of an assembled collapsible reel according to the present invention.
Figure 2:
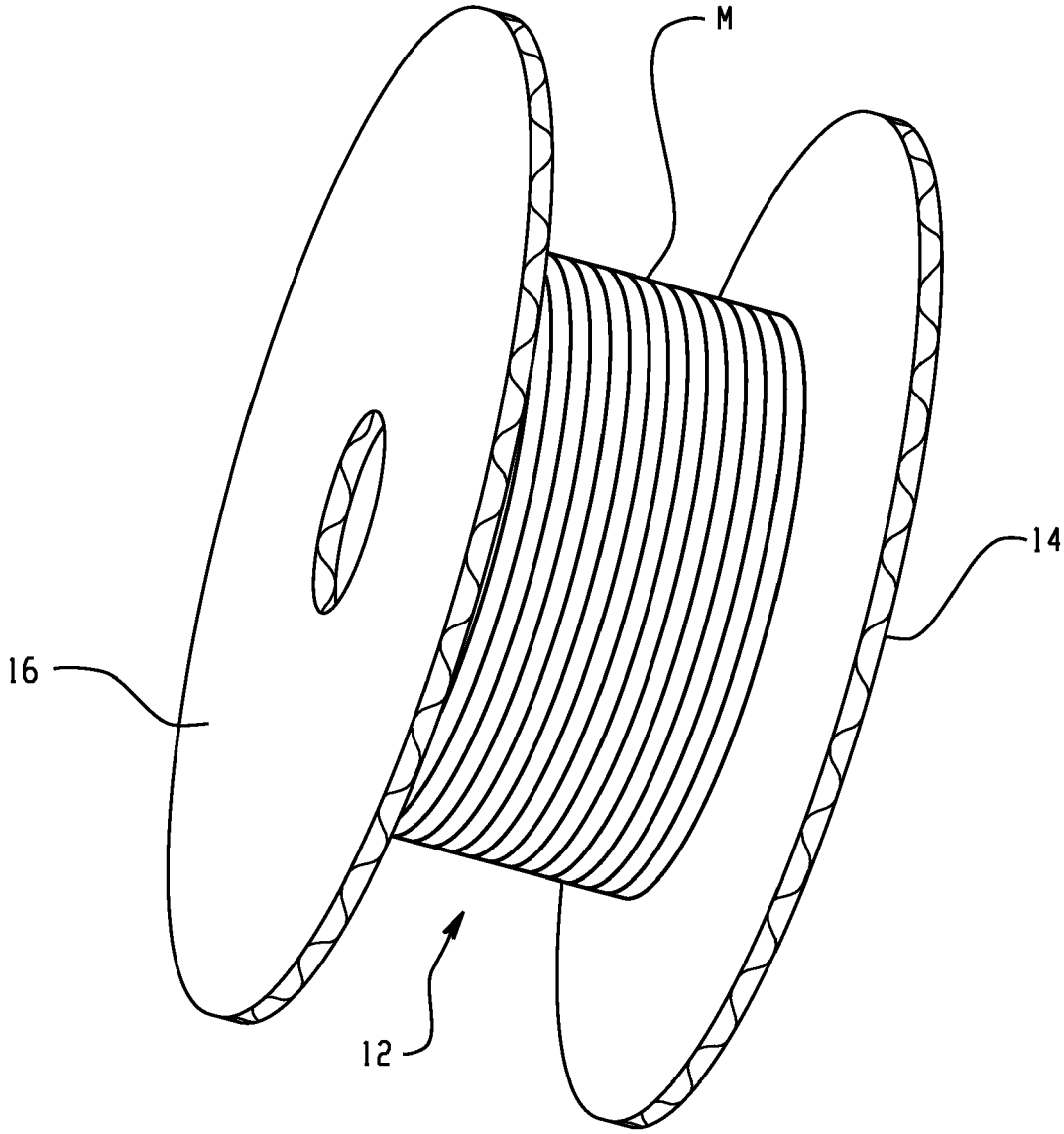
Figure 3:
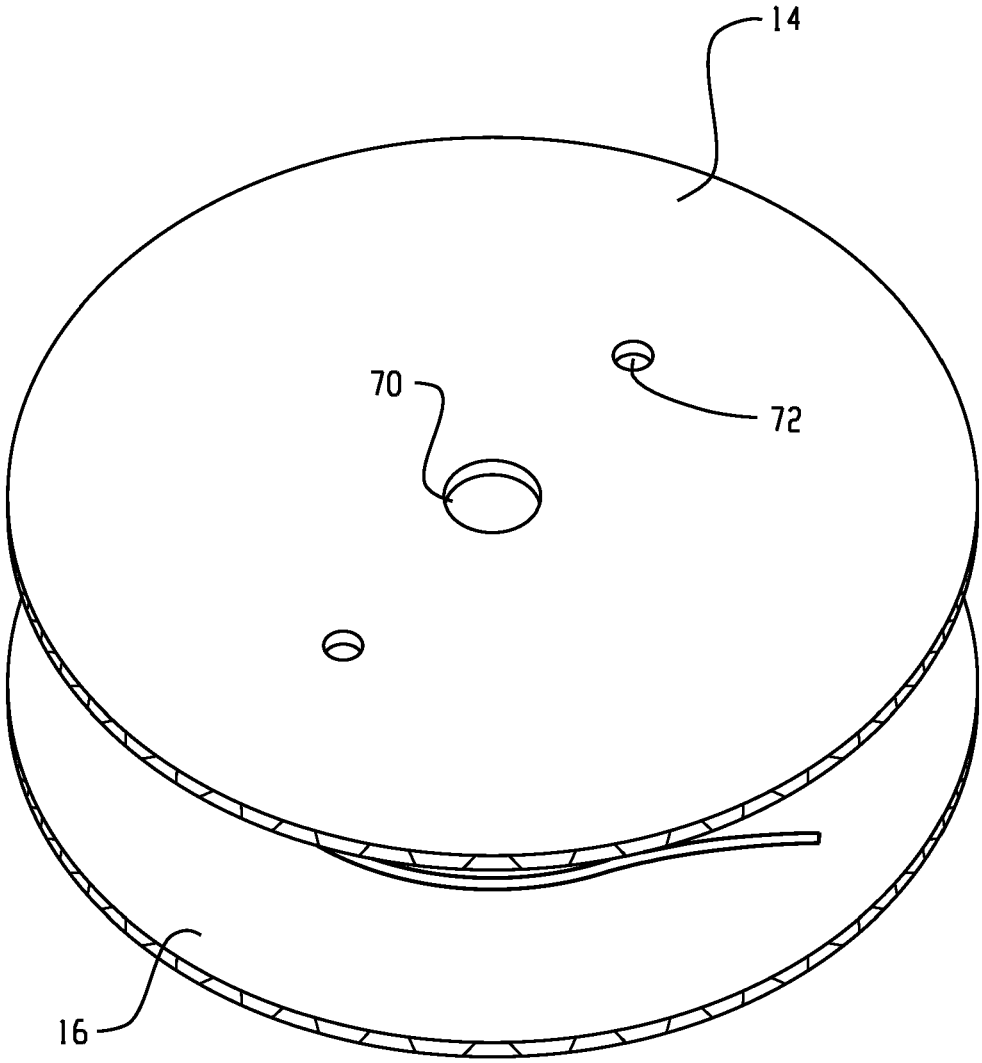
Figure 4:
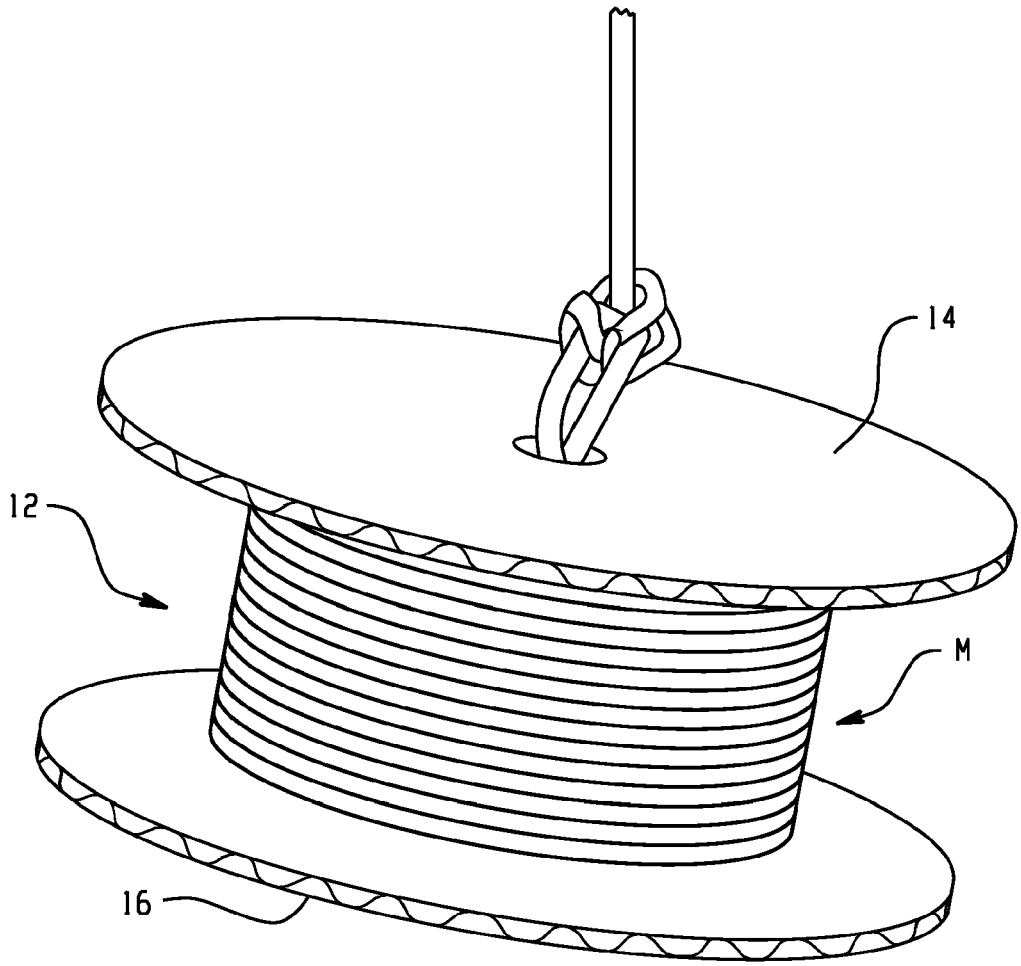

The description and drawings herein are merely illustrative and various modifications and changes can be made to the components and arrangement(s) of components without departing from the spirit of the invention. Like numerals refer to like parts throughout the several views.

Referring now to the drawings and particularly FIGS. 1-4, a collapsible reel is formed of suitable foldable form-retaining sheet material such as corrugated paper board with conventional, well-known equipment. The general components of the reel 10 include its longitudinally extending core 12, around which a flexible media M is wound, and its flanges 14, 16, which are preferably of circular configuration. The flanges prevent the wound flexible media from migrating axially off of the core. As will be discussed in greater detail below, the reel may assume a collapsed condition, and in such condition, may be readily stored and shipped by the manufacturer in the collapsed condition with a resultant dramatic reduction in shipping volume. In addition, the reel may be subsequently assembled by the end user without the inconvenience of an adhesive, staples and other securing devices.

Figure 6:
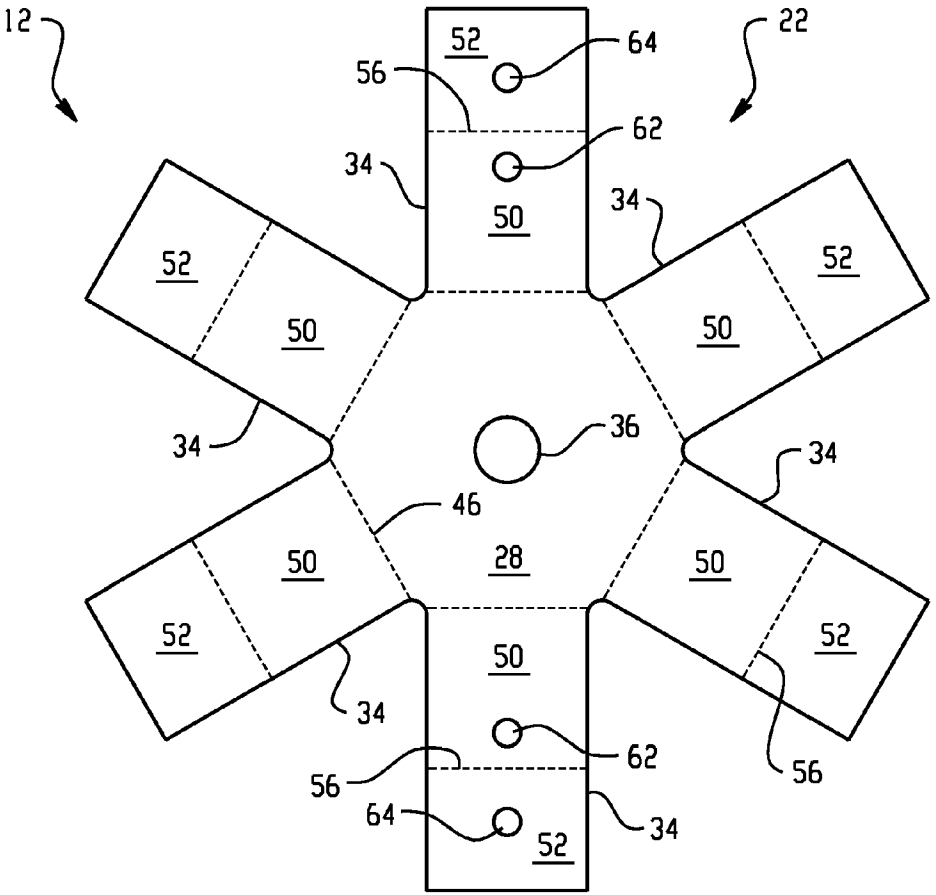
FIG. 6 is a top plan view of a second blank for forming the core.
Figure 5:
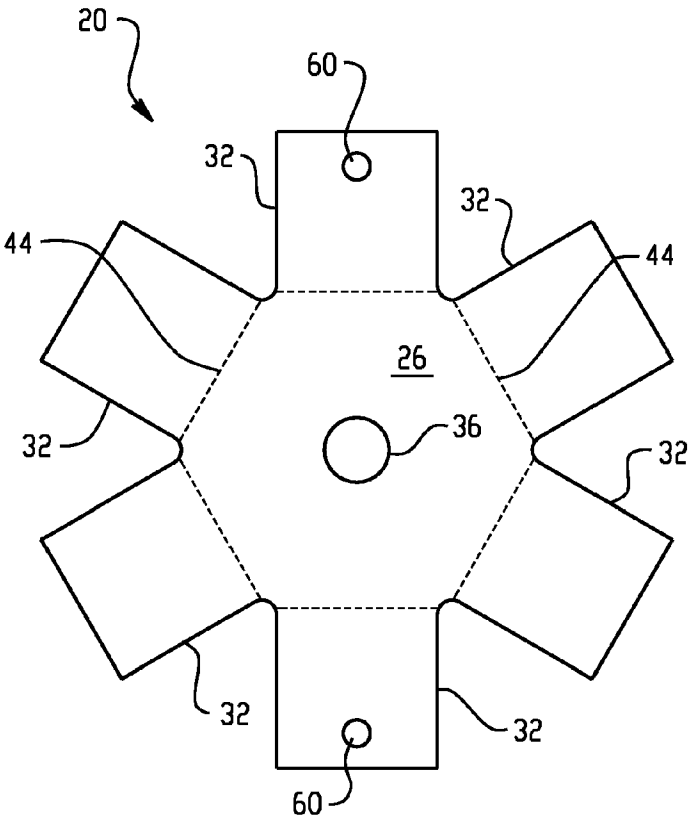
FIG. 5 is a top plan view of a first blank for forming a core of the collapsible reel.
Figure 8:
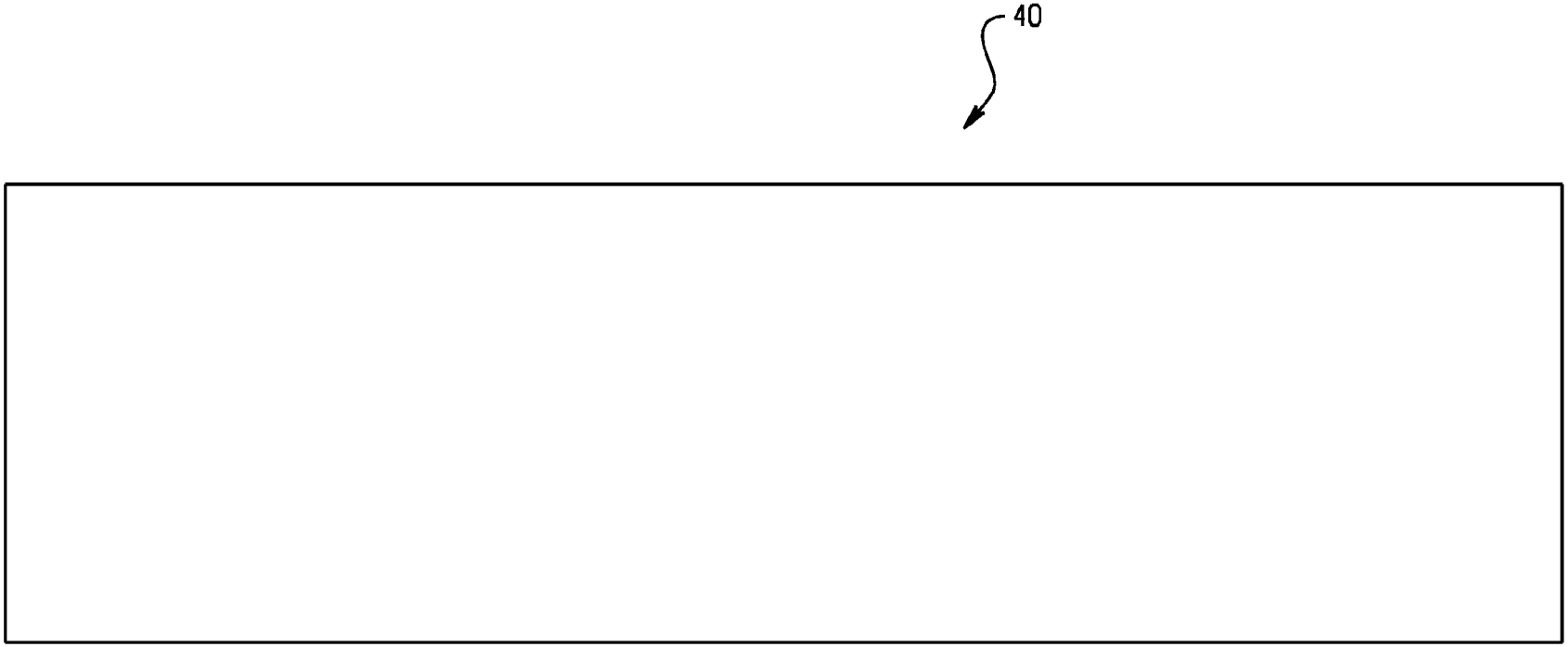
FIG. 8 is a side elevational view of a spindle.

With reference to FIGS. 5 and 6, the core 12 comprises a first blank 20 and a second blank 22, which are adapted to subsequently mate together. Each blank is formed from a heavy duty corrugated board having at least one layer of corrugations or flutes. The first and second blanks include respective hub portions 26 and 28 and a plurality of equal length, spaced apart tabs 32 and 34, respectively, which radiate from the hub portions. In this embodiment, the hub portions have a hexagon-shaped configuration; although it will be appreciated that other polygonal configurations, besides hexagonal, are also contemplated. Each hub portion includes a central bearing/arbor opening 36 dimensioned to receive a spindle 40 (FIG. 8) which generally extends in an orthogonal direction relative to the flanges.

The plurality of tabs 32, 34 project outwardly from respective first score fold lines 44 and 46 which define the sides or ends of each hub portion 32, 34 as will become more apparent below. The tabs 32 of the first blank 20 are somewhat shorter than the tabs 34 of the second blank 22. The tabs 34 of the second blank each preferably include a first section 50 and a second section 52. The first section is separated from the second section by a second score or fold line 56. As will be discussed in greater detail below, these second sections 52 constitute joining or locking flaps for joining the first blank 20 to the second blank 22, particularly tabs 32 to tabs 34.

As shown in FIG. 5, at least one pair of axially opposing tabs 32 includes a location/indicator hole 60. As shown in FIG. 6, at least one pair of axially opposing tabs 34 includes first and second location/indicator holes 62 and 64, respectively, equally radially spaced from the second fold line 56. The spacing of indicator holes 62 and 64 is such that when the second section 52 of those particular tabs is folded along the second fold line radially disposed between the indicator holes onto its corresponding first section 50, the first indicator hole 62 is in registry with the second indicator hole 64.

To assemble the core, generally the second section 52 of each tab 34 of the second blank is secured to a section of each tab 32 of the first blank. More specifically, each tab 34 is folded along the second fold line 56. Once folded, the first indicator hole 62 will be aligned with the second indicator hole 64. The first blank 20 is then placed on top of the second partially folded blank 22. Before securing the tabs 32 to the second sections of tabs 34, tabs 32 are properly positioned onto the second sections 52 of tabs 34 by aligning indicator holes 60 with first and second indicator holes 62, 64 and aligning the arbor openings 36 of each hub section 26, 28. Each tab 32 is then secured to the second section 52 of each tab 34 preferably by a suitable adhesive.

Figure 7:
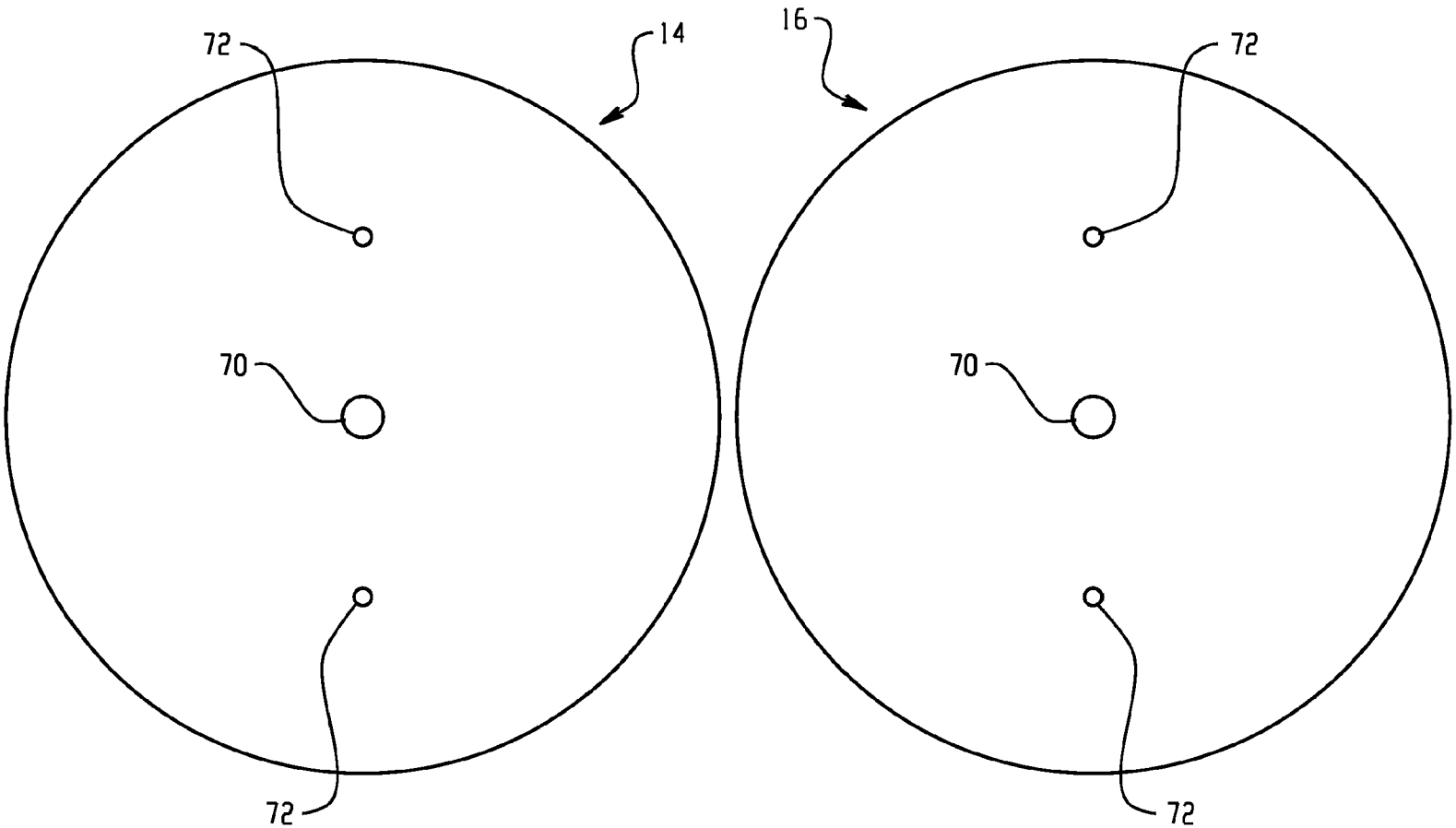
FIG. 7 is a top plan view of a pair of flanges which are attached to the core of the collapsible reel.

Referring to FIG. 7, the flanges 14, 16 are of substantially identical construction to one another and are also made from a heavy duty corrugated board. It is contemplated that each flange may include at least two layers of corrugations. Generally, the corrugations of one layer are transverse to, preferably perpendicular to, the corrugations of the other layer so as to obtain maximum strength. Each flange includes a central bearing/arbor opening 70 dimensioned to receive the spindle 40. Once assembled to the core 12, the flange openings 70 align with the arbor openings 36. Each flange further includes a pair of diametrically spaced location/indicator holes 72 which, as will be discussed in greater detail below, ensure the proper positioning of the flanges on the hub portions 26, 28 of the blanks 20, 22.

Finally, the flanges 14, 16 are adhered to the outer surface of each hub section. Again, to ensure proper placement of the flanges, the indicator holes 72 are aligned with indicator holes 60, 62, 64 and the arbor openings 70 are aligned with arbor openings 36 of the hub sections. Once secured, the flanges 14, 16 at least triple the thickness of the hub sections 26, 28 (i.e. at least three layers of corrugated board) thereby increasing the strength of the arbor openings. It should be appreciated that the above method of assembling the reel 10 is by way of example only, and is not intended to be limitative of the invention, that the reel can be assembled by other methods, such methods falling within the scope of the present invention. Thus, the components of the reel 10 may be united in a fast and economical manner, and when so united, may be shipped and stored in a flat condition occupying a minimum of space.

Figure 9:
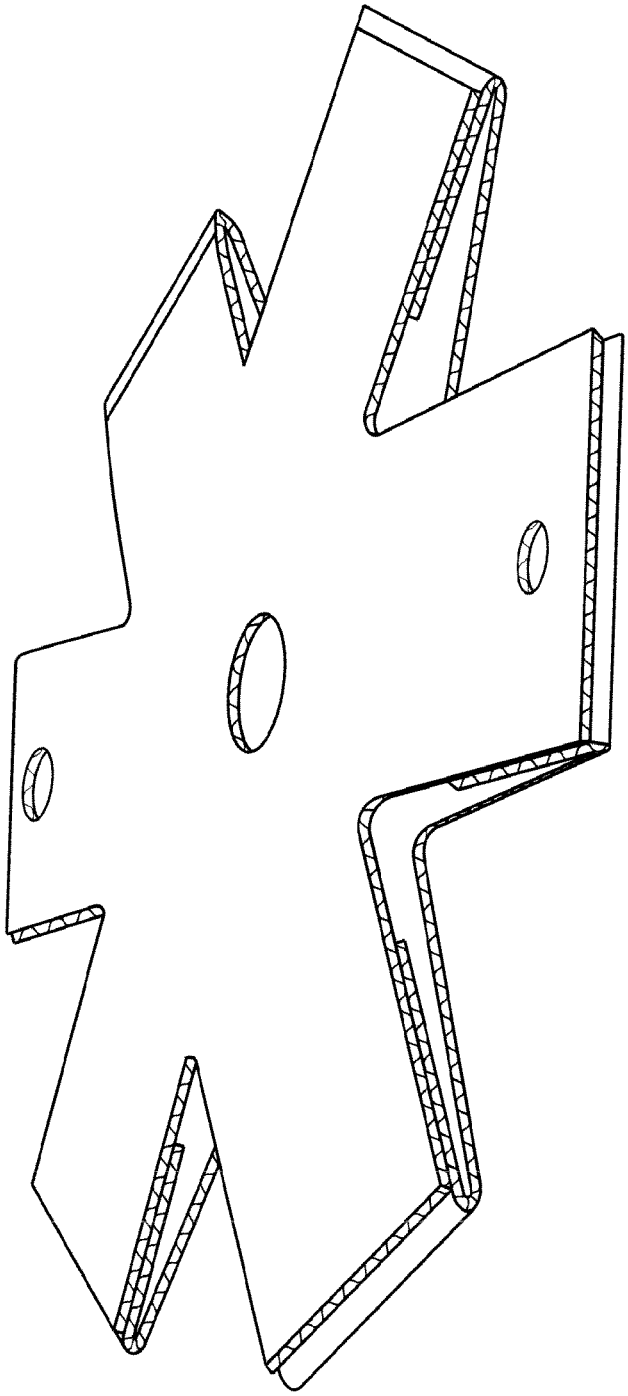
FIGS. 9-11 are illustrations of the deployment/assembly of the core.
Figure 10:
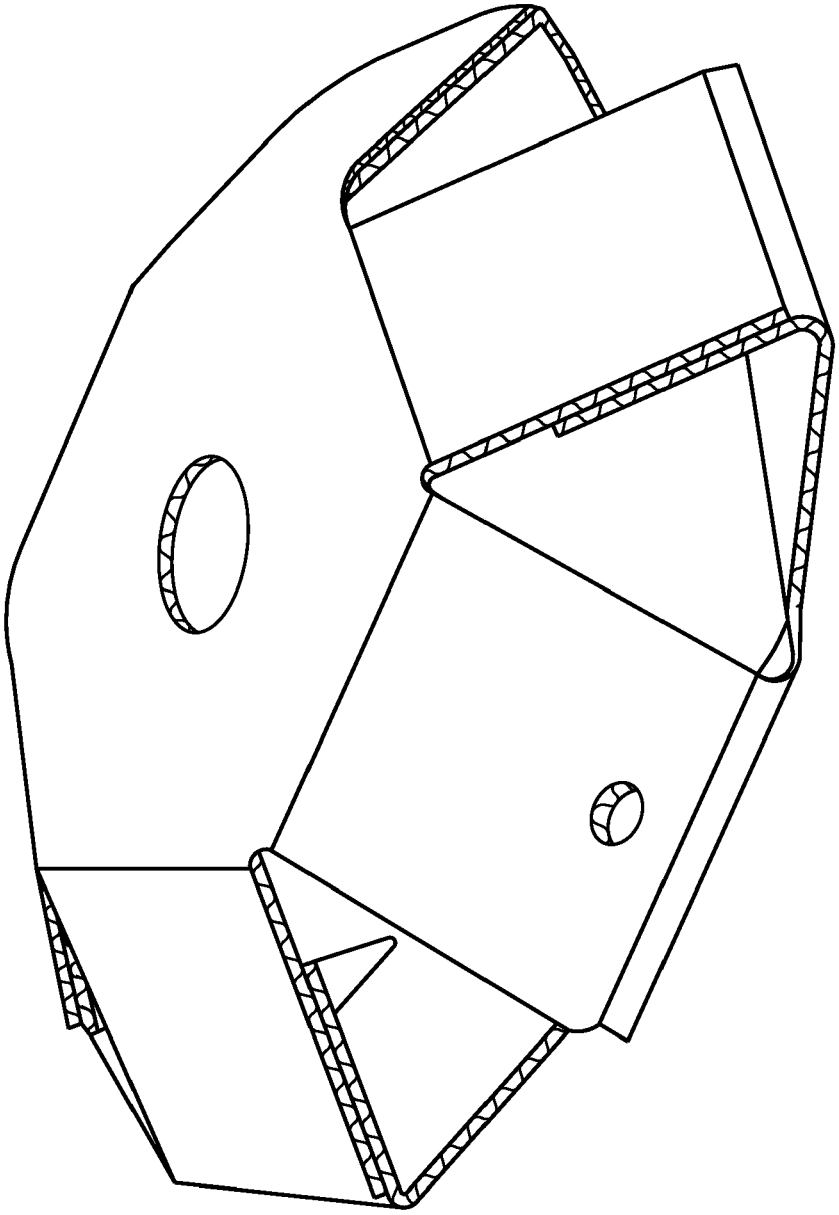
Figure 11:
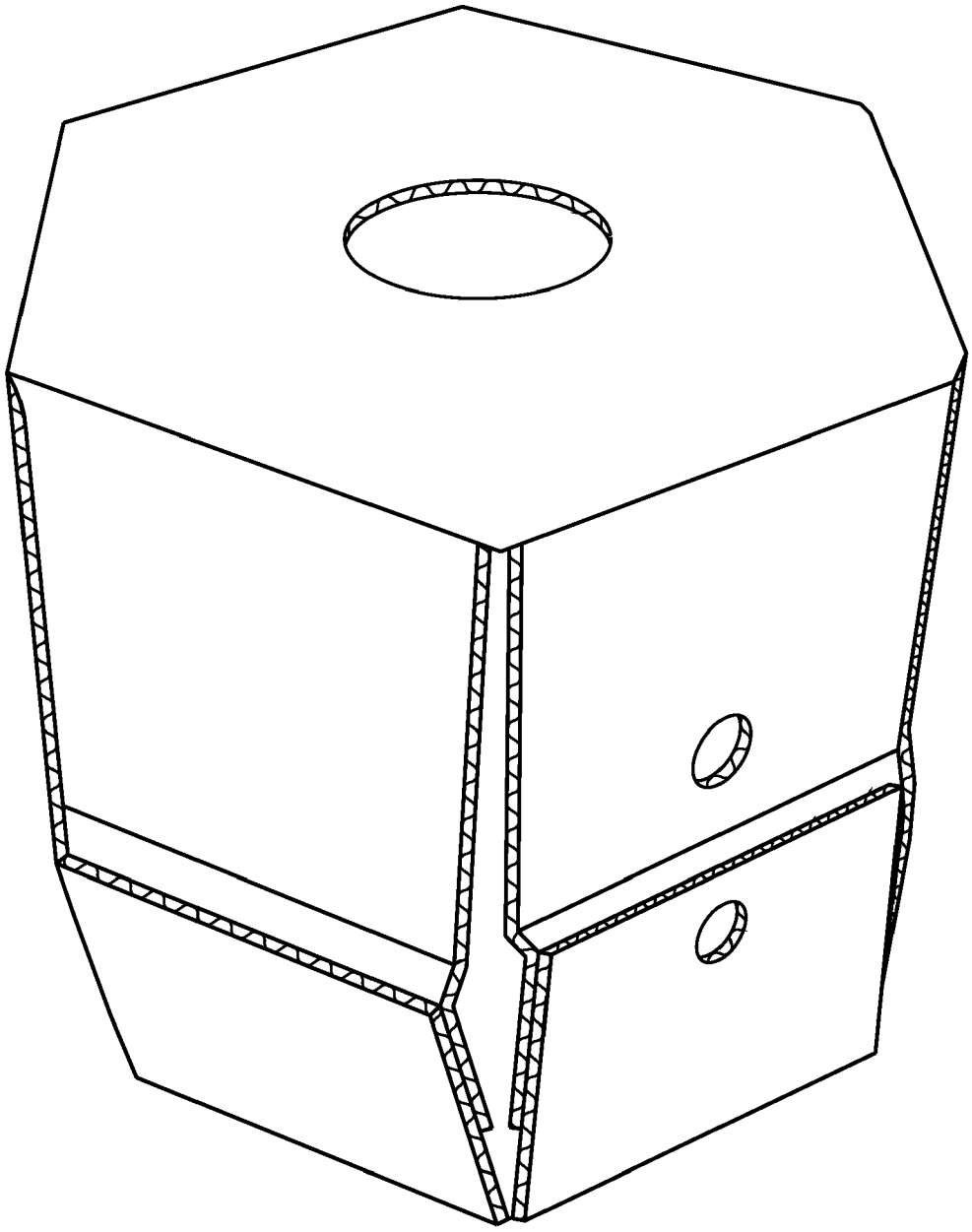

The united pair of blanks 20 and 22 described above may be shaped to reel form in various ways. The flanges/hub portions 26, 28 are separated from one another along an axis that coincides with the linear axis extending through aligned openings 36. As the hub portions are separated (FIG. 10) from their abutting relation in the collapsed condition (FIG. 9), the tabs 32 and 34 fold along the first fold lines 44. As the tabs begin to fold, the volume of the reel increases. That is, the overall volume of the reel increases and more importantly, the storage region defined radially outward of the hub/core and between the flanges that receive the wire/cable or the like also increases. Once fully expanded, the tabs 32 and 34 are orientated generally normal to the hub sections 26, 28 and together define the cylindrical or tubular core 12 (FIG. 11). In addition, once expanded, the first and second fold lines 44, 56 allow the reel 10 to be self-erected and hold the expanded shape without the additional use of metal or additional adhesive.

After the reel 10 has been so shaped, it may be placed directly upon a winding mandrel (not shown) and flexible media M (FIGS. 5-8) such as wire, cable, flexible tube or hose is wound upon the core 12. Ordinarily, the media wound upon the reel 10 is adequate to hold the reel in its desired form. However, if desired, a strip of corrugated paperboard or other material may be wound upon the folded tabs and releasably secured thereon to maintain the shape of the reel. This would also provide a smooth liner surface upon which the flexible media may be wound. It should also be appreciated that the included angle between adjacent tabs 32 of the first blank 20 and likewise the same included angle between adjacent tabs 34 of the second blank 22 allows the joined tabs to deploy into expanded form. As media is being wound upon the core 12, the united tabs are pressed slightly inward until the side edge of one united tab abuts the side edge of an adjacent united tab. These abutting tabs provide additional strength to the core thereby allowing the reel to hold up to 50 pounds on a wound reel. The abutting tabs exhibit improved strength—akin to hoop strength—that prevents the core from collapsing inwardly into the space or volume interiorly of the core.

When the reel 10 is to be collapsed, the flanges 14, 16 are pushed together which causes the tabs 32 and 34 to fold along the first fold lines 44. This, in turn, causes the tabs 34 to fold outwardly along the second fold lines 56. Thus, the first and second blanks 20, 22 are essentially sandwiched between the flanges.

Figure 12:
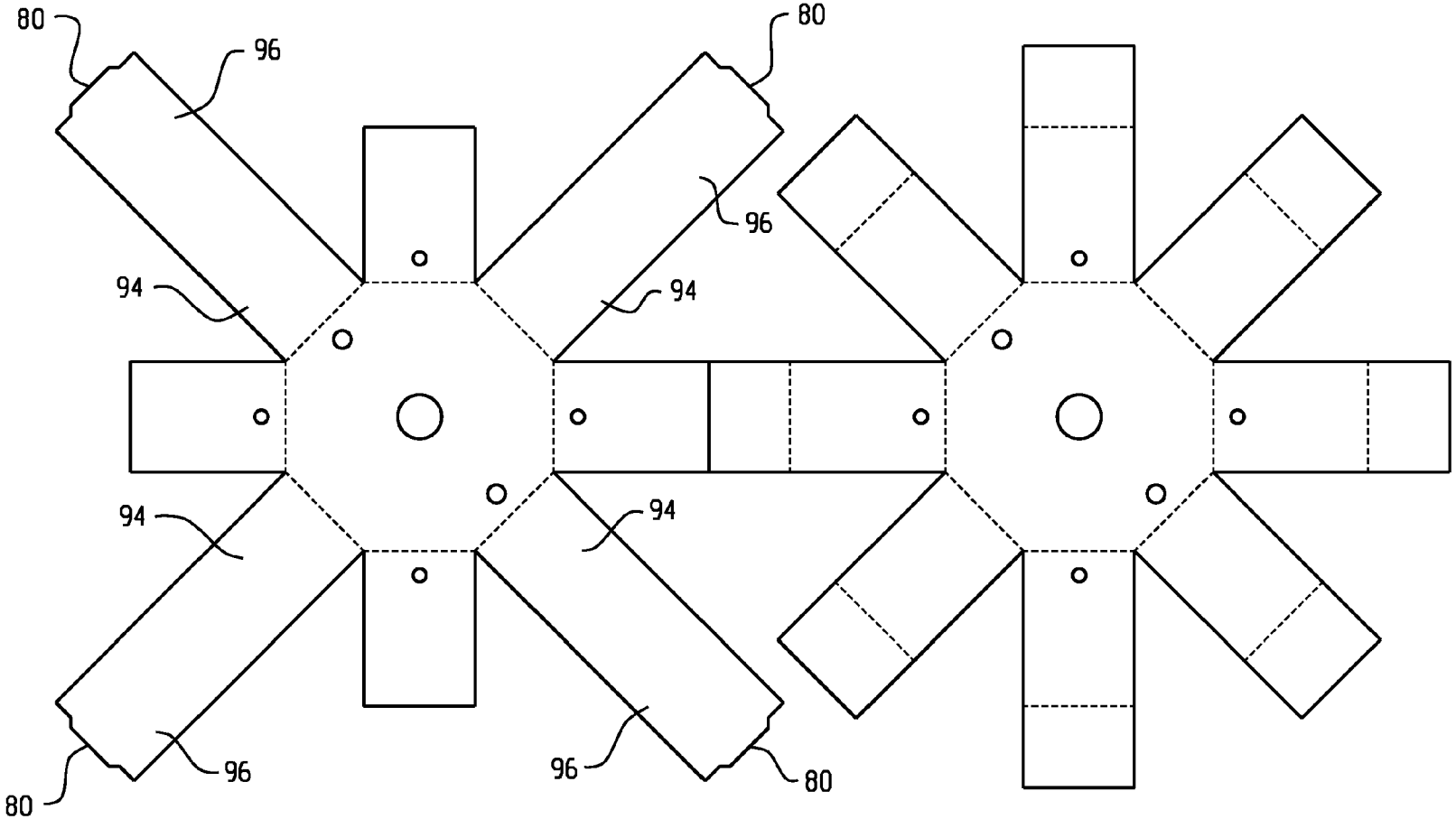
FIG. 12 is a plan view of blank for forming a core that incorporates a multi-point locking feature.
Figure 14:
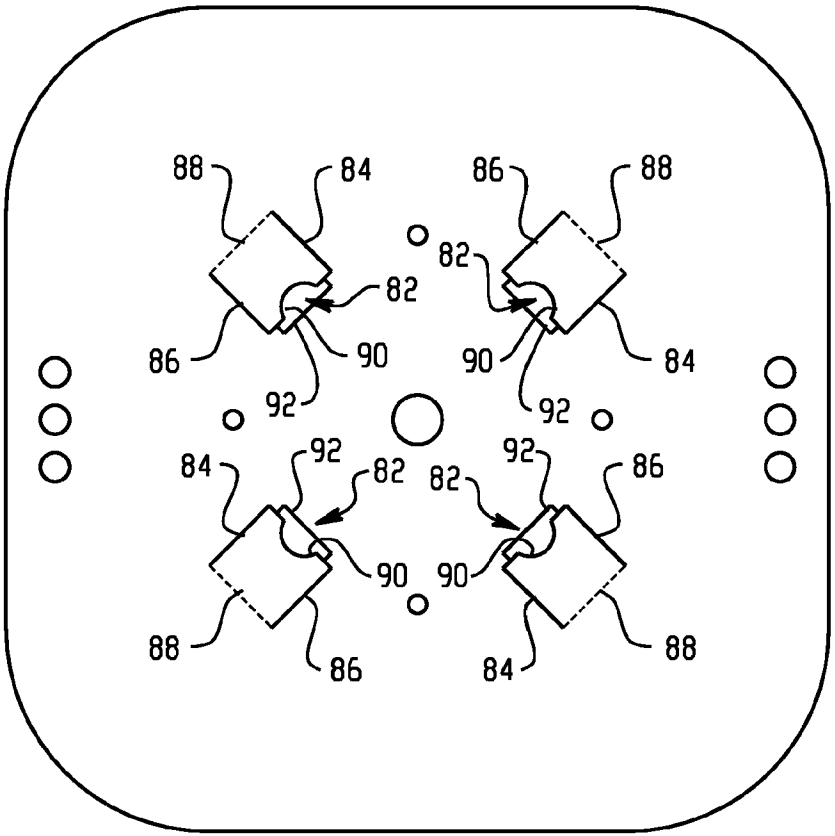
FIGS. 13-14 are plan views of modified flanges that accommodate the locking feature of FIG. 12.
Figure 13:
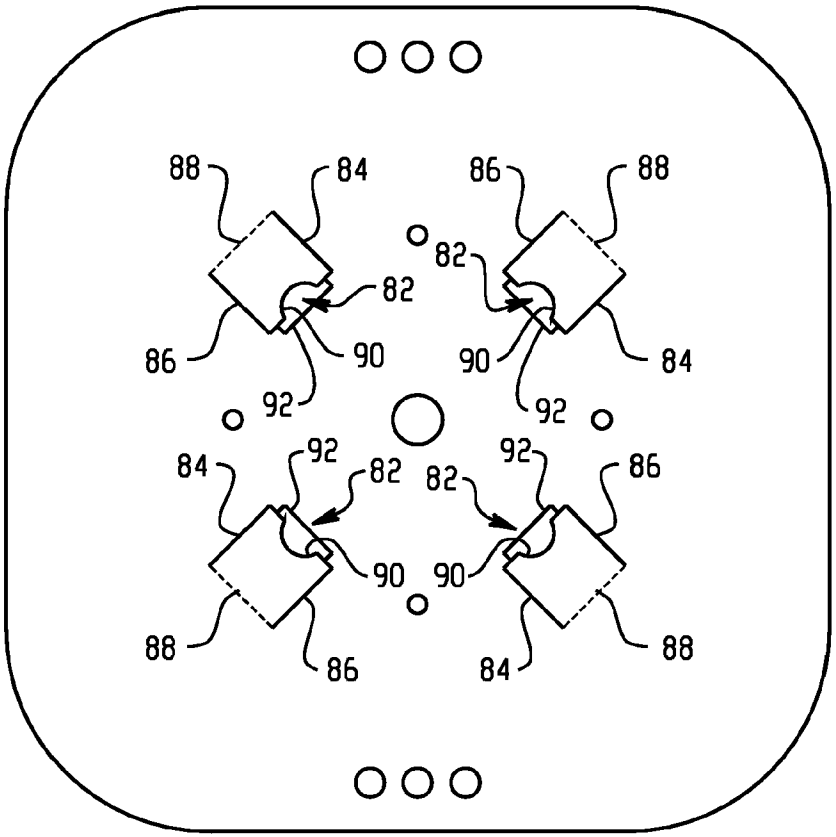

The embodiment of FIG. 12-14 shows formed or partially pointed locking ends 80 on ends of selected tabs for receipt in a locking flap 82 of the associated flange. That is, each locking end 80 cooperates with a corresponding, associated locking flap that is separated or cut from the remainder of the flange along two sides 84, 86, and hinged along fold or hinge region 88. An opposite or free end 90 of each flap has a finger recess that is disposed adjacent shoulder 92 in the flange and abuts against the end 80 received against the shoulder 92. The locking ends 80 extend into an adjacent locking flap and the flap may be moved along the hinge region into co-planar relation with the remainder of the flange to engage the locking flap and end together. By depressing the flap and at least partially rotating the flap along the hinge region 88, the free end 90 of the tab is free to move relative to the shoulder for purposes of collapsing the reel assembly. Although the pointed ends are shown on alternating tabs, this may be varied as desired. Further, those tabs that have a pointed locking end 80 have an extended length in order that a first or inner portion 94 is secured to the mating tab of the other hub portion while the extended length 96 of the longer tabs permit the locking end to engage with the locking flap 82 of the opposite flange. Also, the locking flaps are provided in each flange so that the core can be axially disposed in either direction between the flanges.

Figure 16:
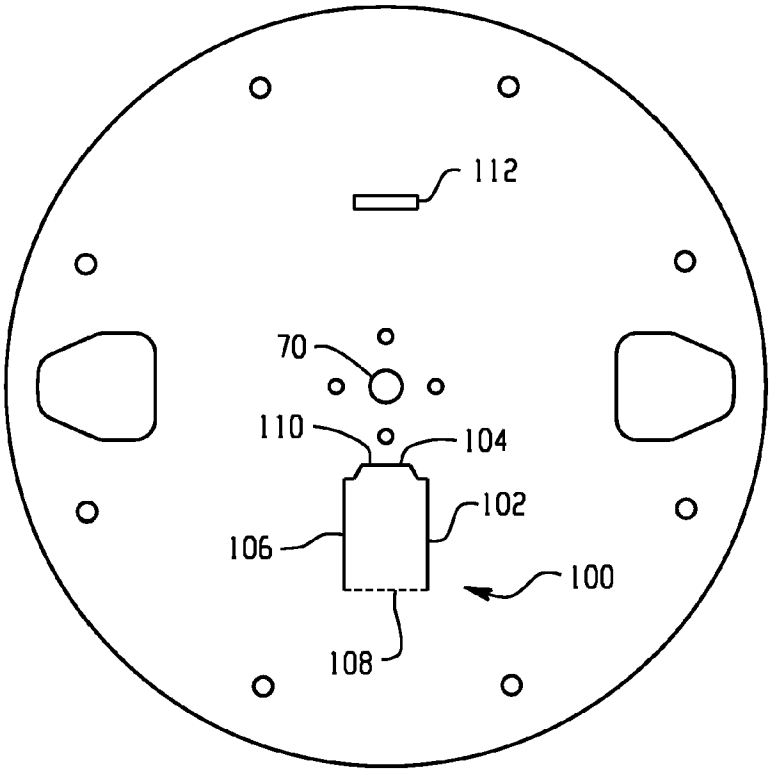
FIGS. 15-16 are plan views of modified flanges that incorporate a different locking feature for the core.
Figure 15:
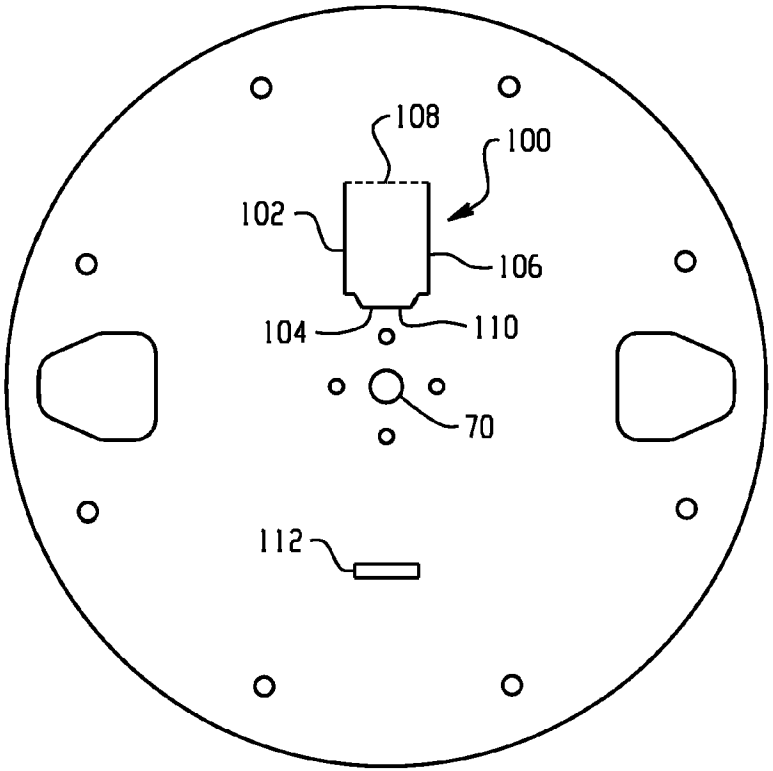

In FIGS. 15 and 16, an alternative (or additional) locking feature is provided. Specifically, each flange has a locking member 100 that is cut along three contiguous edges 102, 104, 106 and the fourth edge forms a hinge 108 to allow the locking member to be depressed substantially perpendicular to the plane of the flange and inwardly toward the opposite flange. Further, each locking member preferably has a pointed end 110 that is received in a slot or opening 112 in the opposite flange. This locates and locks the flanges apart a predetermined dimension defined by the length of the locking member. Thus, as appreciated, the slot 112 in the flange is located approximately the same distance from the arbor opening 70 as the hinge 108 of the locking member.

These locking arrangements enhance the stability of the assembled reel with simple mechanical locking features and still allow the collapsible reel to be unlocked and subsequently collapsed if desired.

As is evident from the foregoing, the collapsible reel 10 may be economically manufactured substantially entirely of corrugated paper board, as indicated, and in addition, may be shipped in flattened condition, to thereby conserve shipping and storage space. The flanges are preferably constructed of a heavy duty corrugated board having multiple layers corrugations, for additional strength, the corrugations of one layer being transverse to the corrugations of the other layer. It will also be appreciated that other materials of construction may be used while employing different features of the present disclosure. For example, instead of corrugate board, plastic or corrugate plastic may be used with other aspects of the collapsible reel or other recycled or recyclable materials may be used with equal success.

The present invention has been described with reference to a preferred embodiment. Obviously, modifications and alterations will occur to others upon reading and understanding the preceding detailed description. It is intended that the present invention be construed as including all such modifications and alterations insofar as they come within the scope of the present invention.

Having thus described the invention, it is now claimed:

1. A reel comprising a core, around which an associated flexible media is wound, the core having first and second hub portions and a plurality of spaced apart tabs projecting from the hub portions, the first hub portion having longer, first tabs and shorter, second tabs of different lengths, the first and second tabs of the first hub portion being secured to respective tabs of the second hub portion; and first and second flanges disposed at opposite ends of the core which prevent the wound flexible media from migrating off of the core, locking features at free ends of at least some of the first tabs of the first hub portion that cooperate with openings in one of the flanges to assist in erection of the reel.

2. The reel of claim 1 wherein the flanges are secured to the hub portions.

3. The reel of claim 2 wherein the tabs of each hub portion are folded to allow the flanges to be selectively advanced toward one another to collapse the reel.

4. The reel of claim 1 wherein the flanges are secured to the hub portions.

5. The reel of claim 1 wherein the tabs of each hub portion is folded to allow the flanges to be selectively advanced toward one another to collapse the reel.

6. The reel of claim 1 wherein the core and flanges are made from a corrugate material.

7. The reel of claim 1 wherein the core and flange are made from a corrugate paper material.

8. The reel of claim 1 wherein the core is adhesively secured at opposite ends to the flanges.

9. The reel of claim 1 wherein the tabs of the first and second hub portions are adhesively secured together.

10. The reel of claim 1 wherein the tabs extending from the second hub portion include first and second fold score lines that are spaced from one another for permitting the first and second flanges to be advanced toward one another to collapse the reel while the tabs extending from the first and second hub portions are secured together.

11. The reel of claim 1 wherein the first hub portion is secured to the first flange, and at least some of the tabs extending from the first hub portion include the locking features at terminal ends thereof that are received in locking features of the second flange.

12. A method of assembling a collapsible reel comprising:

providing first and second hub portions wherein at least one of the hub portions has longer, first tabs and shorter, second tabs of different lengths, securing the first and second tabs of the first hub portion to respective tabs of the second hub portion;

providing first and second scored fold lines in radially spaced relation along the tabs of the second hub portion;

securing the tabs extending from the first hub portion to regions between the outer radial scored fold lines and terminal ends of corresponding tabs extending from the second hub portion;

pulling first and second flanges apart; and straightening adjoining tabs to form a core interposed between the flanges.

13. The method of claim 12 further comprising locking the flanges in spaced relation.

14. A collapsible reel comprising a core, around which an associated flexible media is wound, the core having first and second hub portions, the first hub portion having longer, first tabs and shorter, second tabs of different lengths, the first tabs of the first hub portion secured to a respective tab of the second hub portion and the second tabs of the first hub portion secured to a respective tab of the second hub portion; and first and second flanges disposed at opposite ends of the core which prevent the wound flexible media from migrating off of the core, the tabs extending from the second hub portion including first and second fold score lines that are spaced from one another and the portion of each of the tabs extending from the second hub portion between a radial outer first and second score line and a terminal end of the tab is secured to the corresponding tab extending from the first hub portion for permitting the first and second flanges to be advanced toward one another to collapse the reel when the tabs extending from the first and second hub portions are secured together.

* * * * *

UNITED STATES PATENT AND TRADEMARK OFFICE

CERTIFICATE OF CORRECTION

PATENT NO. : 8,480,024 B2
APPLICATION NO. : 12/681046
DATED : July 9, 2013
INVENTOR(S) : William J. Ries It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 12 days.

Signed and Sealed this
Eighth Day of September, 2015

Michelle K. Lee

Michelle K. Lee
*Director of the United States Patent and Trademark Office*